US010319304B2

(12) United States Patent
Kuang et al.

(10) Patent No.: US 10,319,304 B2
(45) Date of Patent: Jun. 11, 2019

(54) OLED PIXEL DRIVING CIRCUIT AND PIXEL DRIVING METHOD

(71) Applicant: Shenzhen China Star Optoelectronics Technology Co., Ltd., Shenzhen (CN)

(72) Inventors: Jimu Kuang, Shenzhen (CN); Yichien Wen, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 222 days.

(21) Appl. No.: 15/519,840

(22) PCT Filed: Mar. 16, 2017

(86) PCT No.: PCT/CN2017/076862

§ 371 (c)(1),
(2) Date: Apr. 18, 2017

(87) PCT Pub. No.: WO2018/152896

PCT Pub. Date: Aug. 30, 2018

(65) Prior Publication Data

US 2018/0301091 A1 Oct. 18, 2018

(30) Foreign Application Priority Data

Feb. 24, 2017 (CN) ..... 2017 1 0104789

(51) Int. Cl.
*G09G 3/3208* (2016.01)
*G09G 3/3258* (2016.01)

(52) U.S. Cl.
CPC ..... *G09G 3/3258* (2013.01); *G09G 3/3208* (2013.01); *G09G 2300/0819* (2013.01);
(Continued)

(58) Field of Classification Search
CPC ..... G09G 3/3258; G09G 3/3208; G09G 2300/0819; G09G 2320/0233; G09G 2320/045
See application file for complete search history.

(56) References Cited

U.S. PATENT DOCUMENTS

2015/0371587 A1* 12/2015 Chen ..... G09G 3/3233 345/76
2016/0041676 A1* 2/2016 Tan ..... G06F 3/0416 345/173

FOREIGN PATENT DOCUMENTS

CN 105304012 A 2/2016

* cited by examiner

*Primary Examiner* — Robert J Michaud
(74) *Attorney, Agent, or Firm* — Leong C. Lei

(57) ABSTRACT

The present invention provides an OLED pixel driving circuit and a pixel driving method. The OLED pixel driving circuit utilizes the 7T2C structure, and comprises a first N type thin film transistor (T1), a second N type thin film transistor (T2), a third N type thin film transistor (T3), a fourth N type thin film transistor (T4), a fifth P type thin film transistor (T5), a sixth N type thin film transistor (T6), a seventh P type thin film transistor (T7), a first capacitor (C1), a second capacitor (C2) and an organic light emitting diode (D1), and the first scan signal (Scan1), the second scan signal (Scan2), the third scan signal (Scan3), the light emitting control signal (EM) and the data signal (Data) are combined with one another to correspond to a reset stage, a threshold voltage detection stage, a program stage and a light emitting stage one after another.

14 Claims, 7 Drawing Sheets

(52) U.S. Cl.
CPC ..... *G09G 2320/0233* (2013.01); *G09G 2320/045* (2013.01); *G09G 2320/0646* (2013.01)

OLED PIXEL DRIVING CIRCUIT AND PIXEL DRIVING METHOD

FIELD OF THE INVENTION

The present invention relates to a display technology field, and more particularly to an OLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the OLED pixel driving circuit needs to accomplish the task of converting the voltage signals into the current signals. The traditional OLED pixel driving circuit generally is 2T1C, which is a structure comprising two thin film transistors and one capacitor to convert the voltage into the current.

As shown in FIG. 1, the traditional 2T1C pixel driving circuit used for OLED comprises: a first thin film transistor T10, a second thin film transistor T20 and a capacitor C10. The first thin film transistor T10 is a N type thin film transistor, which is used to be a switch thin film transistor; the second thin film transistor T20 is a P type thin film transistor, which is used to be a driving thin film transistor; the capacitor C10 is a storage capacitor. Specifically, a gate of the first thin film transistor T10 receives a scan signal Scan, and a source receives a data signal Data, and a drain is electrically coupled to the gate of the second thin film transistor T20 and one end of the capacitor C10; a source of the second thin film transistor T20 receives a power source voltage VDD, and a drain is electrically coupled to an anode of the organic light emitting diode D10; a cathode of the organic light emitting diode D10 receives a common ground voltage VSS; one end of the capacitor C10 is electrically coupled to a gate of the second thin film transistor T20, and the other end is electrically coupled to a source of the second thin film transistor T20. As the OLED displays, the scan signal Scan controls the first thin film transistor T10 to be activated, and the data signal Data enters the gate of the second thin film transistor T20 and the capacitor C10 via the first thin film transistor T10. Then, the first thin film transistor T10 is deactivated. With the storage function of the capacitor C10, the gate voltage of the second thin film transistor T20 can remain to hold the data signal voltage to make the second thin film transistor T20 to be in the conducted state to drive the current to enter the organic light emitting diode D10 via the second thin film transistor T20 and to drive the organic light emitting diode D10 to emit light.

The formula of the current flowing through the thin film transistor and the organic light emitting diode according to calculation is:

$$I_{OLED}=K\times(V_{gs}-V_{th})^2$$

wherein $I_{OLED}$ represents a current flowing through the driving thin film transistor and the organic light emitting diode, and K is an intrinsic conductive factor of the driving thin film transistor, and $V_{gs}$ represents a voltage difference between the gate and the source of the driving thin film transistor, and $V_{th}$ represents a threshold voltage of the driving thin film transistor. Accordingly, the value of the $I_{OLED}$ is relevant with the threshold voltage $V_{th}$ of the driving thin film transistor.

The structure of the foregoing traditional OLED pixel driving circuit is simpler and does not possess compensation function, and thus lots of defects exist, wherein the more obvious one is: due to the nonconsistency in the manufacture process of the thin film transistor, the threshold voltages of the driving thin film transistors of all pixels in the OLED display panel are not consistent; and the long period of working time will age the material of the driving thin film transistors to lead to the drifts of the threshold voltages of the driving thin film transistors and the to cause the phenomenon of the nonuniform OLED panel display.

SUMMARY OF THE INVENTION

An objective of the present invention is to provide an OLED pixel driving circuit, which can eliminate the influence of the threshold voltage of the driving thin film transistor to the current flowing through the organic light emitting diode to promote the OLED panel display uniformity.

Another objective of the present invention is to provide an OLED pixel driving method, which can eliminate the influence of the threshold voltage of the driving thin film transistor to the current flowing through the organic light emitting diode to promote the OLED panel display uniformity.

For realizing the aforesaid objectives, the present invention first provides an OLED pixel driving circuit, comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node.

The first scan signal, the second scan signal, the third scan signal, the light emitting control signal, and the data signal are combined with one another to correspond to a reset stage, a threshold voltage detection stage, a program stage and a light emitting stage one after another.

in the reset stage, the first scan signal is a high voltage level, and the second scan signal is a low voltage level, and the third scan signal is a low voltage level, and the light emitting control signal is a low voltage level, and the data signal is a low voltage level; the drain of the sixth N type thin film transistor receives the power source low voltage;

in the threshold voltage detection stage, the first scan signal is a high voltage level, and the second scan signal is a low voltage level, and the light emitting control signal is a low voltage level, and the data signal is a low voltage level;

in the program stage, the first scan signal is a low voltage level, and the second scan signal is a low voltage level, and the third scan signal is a high voltage level, and the light emitting control signal is a low voltage level, and the data signal is a high voltage level;

in the light emitting stage, the first scan signal is a high voltage level, and the second scan signal is a low voltage level, and the third scan signal is a low voltage level, and the light emitting control signal is a high voltage level, and the data signal is a low voltage level; the drain of the sixth N type thin film transistor receives the luminous brightness adjustment voltage;

The power source low voltage is higher than a sum of a threshold voltage of the seventh P type thin film transistor and a threshold voltage of the organic light emitting diode.

The common ground voltage is not higher than the luminous brightness adjustment voltage, and the luminous brightness adjustment voltage is lower than a sum of the power source high voltage and the threshold voltage of the organic light emitting diode minus a voltage value of a high voltage level provided by the data signal.

All of the first scan signal, the second scan signal, the third scan signal, the light emitting control signal and the data signal are generated by an external sequence controller.

all of the first N type thin film transistor, the second N type thin film transistor, the third N type thin film transistor, the fourth N type thin film transistor, the fifth P type thin film transistor, the sixth N type thin film transistor, the seventh P type thin film transistor are low temperature poly-silicon thin film transistors, oxide semiconductor thin film transistors or amorphous silicon thin film transistors.

The present invention further provides an OLED pixel driving method, comprising steps of:

step 1, providing an OLED pixel driving circuit;

the OLED pixel driving circuit comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node;

step 2, entering a reset stage;

the first scan signal providing a high voltage level, and the second scan signal providing a low voltage level, and the third scan signal providing a low voltage level, and the light emitting control signal providing a low voltage level, and the data signal providing a low voltage level; the drain of the sixth N type thin film transistor receiving the power source low voltage;

the fifth P type thin film transistor and the sixth N type thin film transistor being on, and the other thin film transistors being off, and the power source low voltage charging the second capacitor to perform initializing assignment to the second capacitor, and resetting a voltage difference of two ends of the second capacitor to be VDDL-VSS, wherein VDDL represents the power source low voltage, and VSS represents the common ground voltage;

step 3, entering a threshold voltage detection stage;

the first scan signal being changed to be a low voltage level, and the second scan signal being changed to be a high voltage level, and the third scan signal being kept to be a low voltage level, and the light emitting control signal being kept to be a low voltage level, and the data signal being kept to be a low voltage level;

all of the second N type thin film transistor, the fourth N type thin film transistor, the fifth P type thin film transistor and the seventh P type thin film transistor being on, and all of the first N type thin film transistor, the third N type thin film transistor and the sixth N type thin film transistor being off, and the second capacitor being discharged to the seventh P type thin film transistor until an energy storage voltage of the second capacitor is $V_{th}+V_{th_}$OLED, wherein $V_{th}$ is a threshold voltage of the seventh P type thin film transistor, and $V_{th_OLED}$ is a threshold voltage of the organic light emitting diode;

step 4, entering a program stage;

the first scan signal being kept to be a low voltage level, and the second scan signal being changed to be a low voltage level, and the third scan signal being changed to be a high voltage level, and the light emitting diode control signal being kept to be a low voltage level, and the data signal being changed to be a high voltage level;

the first N type thin film transistor and the fifth P type thin film transistor being on, and the other thin film transistors being off, and the data signal charging the first capacitor until an energy storage voltage of the first capacitor and a voltage level of the first node are $V_{Data}$, and $V_{Data}$ is a voltage value of a high voltage level provided by the data signal;

step 5, entering a light emitting stage;

the first scan signal being changed to be a high voltage level, and the second scan signal being kept to be a low voltage level, and the third scan signal being changed to be a low voltage level, and the light emitting control signal being changed to be a high voltage level, and the data signal being changed to be a low voltage level; the drain of the sixth N type thin film transistor receiving the luminous brightness adjustment voltage;

all of the third N type thin film transistor, the sixth N type thin film transistor and the fifth P type thin film transistor being on, and all of the first N type thin film transistor, the second N type thin film transistor, the fourth N type thin film transistor and the fifth P type thin film transistor being off, and the luminous brightness adjustment voltage being sent to the fifth node, and the voltage level of the first node being changed to be:

$$Va=Vr+V_{Data}-V_{th}-V_{th_OLED}$$

wherein $V_a$ represents a voltage level of the first node, and Vr represents the luminous brightness adjustment voltage;

the organic light emitting diode emits light, and a current flowing through the organic light emitting diode is irrelevant with the threshold voltage of the seventh P type thin film transistor.

The power source low voltage is higher than a sum of a threshold voltage of the seventh P type thin film transistor and a threshold voltage of the organic light emitting diode.

The common ground voltage is not higher than the luminous brightness adjustment voltage, and the luminous brightness adjustment voltage is lower than a sum of the power source high voltage and the threshold voltage of the organic light emitting diode minus a voltage value of a high voltage level provided by the data signal.

All of the first scan signal, the second scan signal, the third scan signal, the light emitting control signal and the data signal are generated by an external sequence controller;

all of the first N type thin film transistor, the second N type thin film transistor, the third N type thin film transistor, the fourth N type thin film transistor, the fifth P type thin film transistor, the sixth N type thin film transistor, the seventh P type thin film transistor are low temperature poly-silicon thin film transistors, oxide semiconductor thin film transistors or amorphous silicon thin film transistors.

The present invention further provides an OLED pixel driving circuit, comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node;

wherein the first scan signal, the second scan signal, the third scan signal, the light emitting control signal, and the data signal are combined with one another to correspond to a reset stage, a threshold voltage detection stage, a program stage and a light emitting stage one after another;

in the reset stage, the first scan signal is a high voltage level, and the second scan signal is a low voltage level, and the third scan signal is a low voltage level, and the light emitting control signal is a low voltage level, and the data signal is a low voltage level; the drain of the sixth N type thin film transistor receives the power source low voltage;

in the threshold voltage detection stage, the first scan signal is a high voltage level, and the second scan signal is a low voltage level, and the light emitting control signal is a low voltage level, and the data signal is a low voltage level;

in the program stage, the first scan signal is a low voltage level, and the second scan signal is a low voltage level, and the third scan signal is a high voltage level, and the light emitting control signal is a low voltage level, and the data signal is a high voltage level;

in the light emitting stage, the first scan signal is a high voltage level, and the second scan signal is a low voltage level, and the third scan signal is a low voltage level, and the light emitting control signal is a high voltage level, and the data signal is a low voltage level; the drain of the sixth N type thin film transistor receives the luminous brightness adjustment voltage;

wherein all of the first scan signal, the second scan signal, the third scan signal, the light emitting control signal and the data signal are generated by an external sequence controller.

The benefits of the present invention are: the present invention provides an OLED pixel driving circuit and a pixel driving method, which utilizes the pixel driving circuit of 7T2C structure, and the first scan signal, the second scan signal, the third scan signal, the light emitting control signal and the data signal are combined with one another to correspond to a reset stage, a threshold voltage detection stage, a program stage and a light emitting stage one after another and can eliminate the influence of the threshold voltage of the driving thin film transistor to the current flowing through the organic light emitting diode to promote the OLED panel display uniformity.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
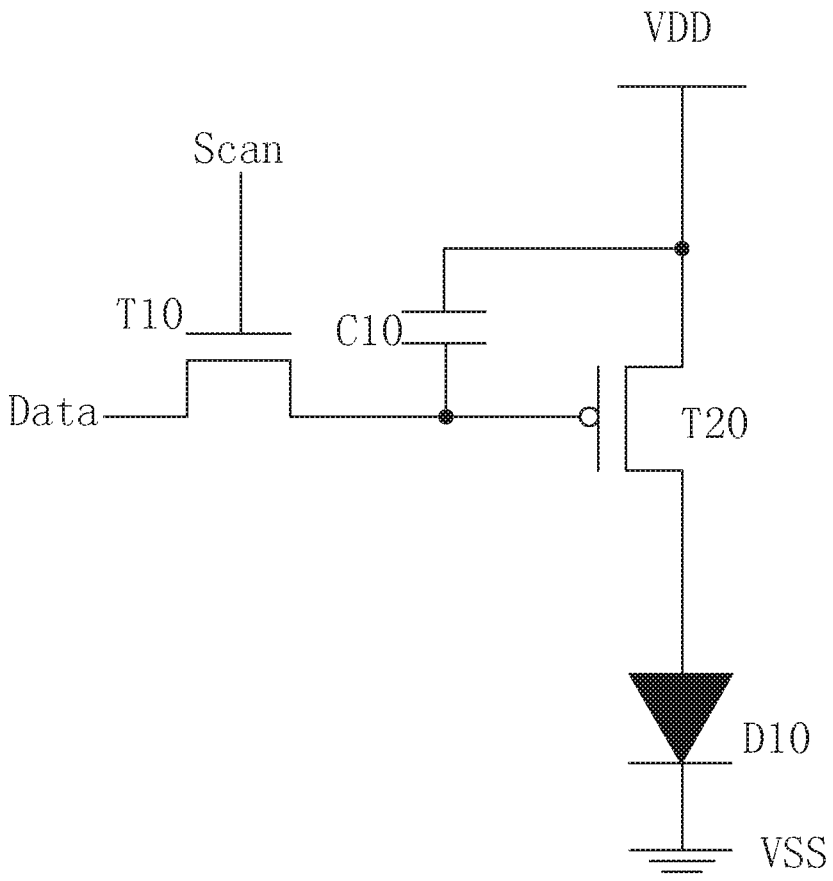
FIG. 1 is a circuit diagram of a pixel driving circuit of traditional 2T1C structure.
Figure 2:
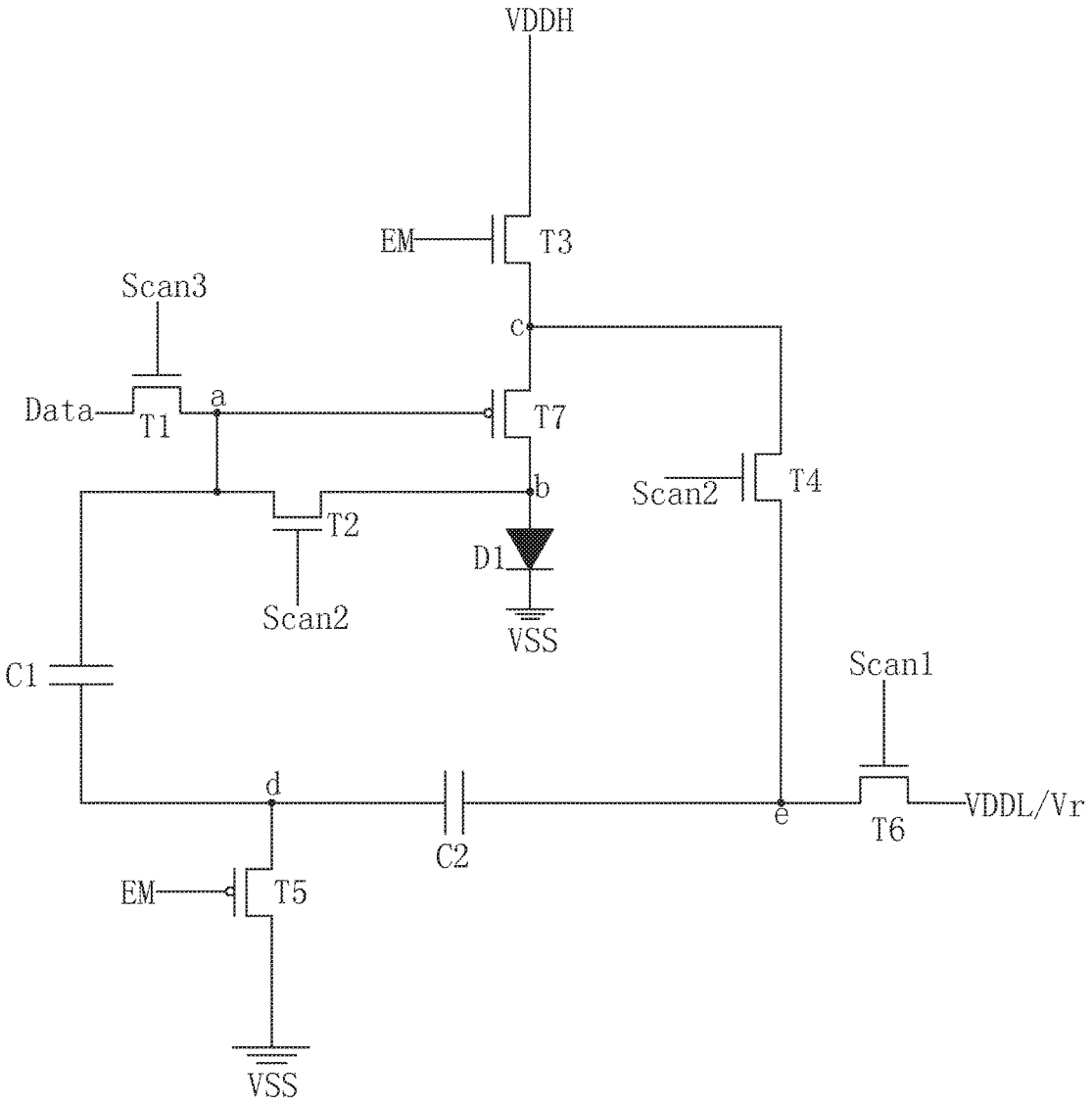
FIG. 2 is a circuit diagram of an OLED pixel driving circuit according to the present invention.
Figure 3:
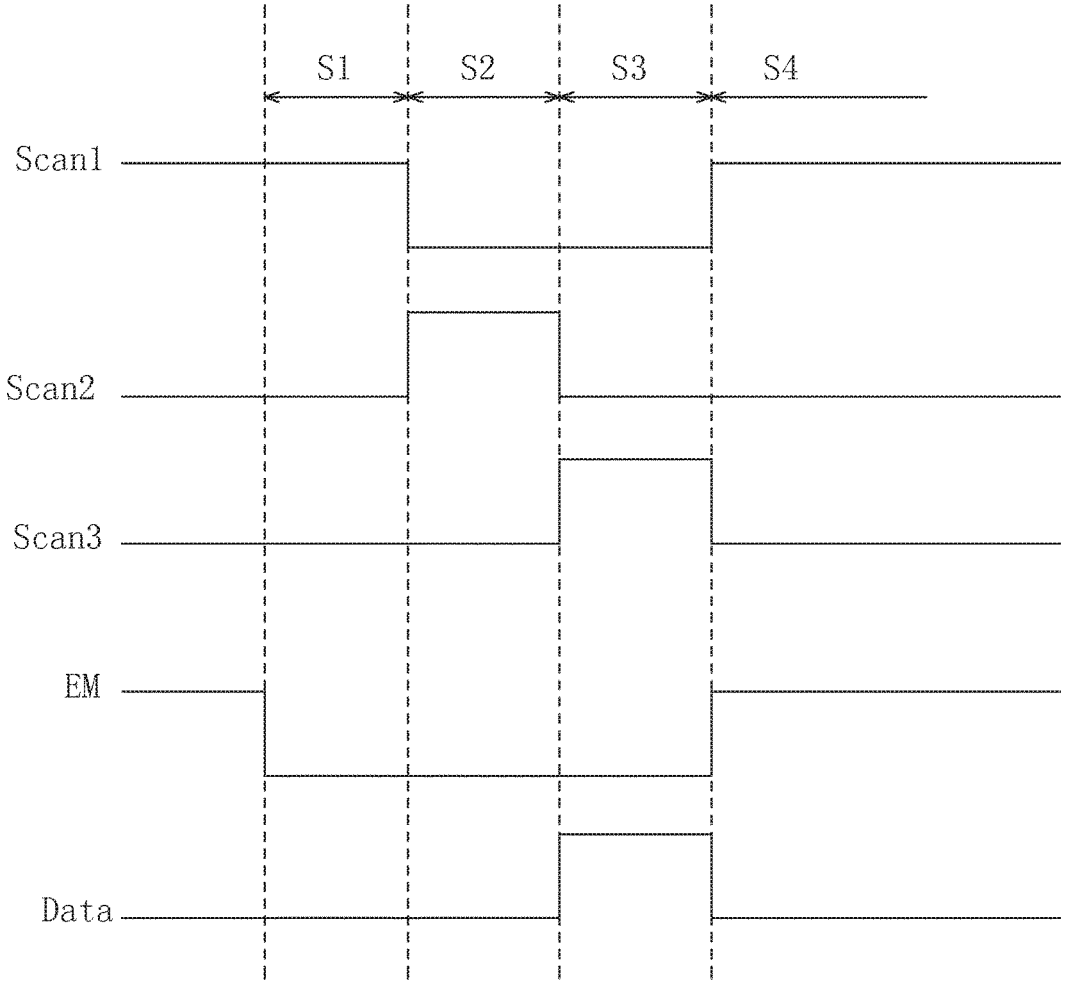
FIG. 3 is a sequence diagram of an OLED pixel driving circuit according to present invention.

Please refer to FIG. 2 and FIG. 3. The present invention first provides an OLED pixel driving circuit, which utilizes the 7T2C structure and comprises a first N type thin film transistor T1, a second N type thin film transistor T2, a third N type thin film transistor T3, a fourth N type thin film transistor T4, a fifth P type thin film transistor T5, a sixth N type thin film transistor T6, a seventh P type thin film transistor T7, a first capacitor C1, a second capacitor C2 and an organic light emitting diode D1.

A gate of the first N type thin film transistor T1 receives a third scan signal Scan3, and a source receives a data signal Data, and a drain is electrically coupled to a first node a; a gate of the second N type thin film transistor T2 receives a second scan signal Scan2, and a source is electrically coupled to the first node a, and a drain is electrically coupled to a second node b; a gate of the third N type thin film transistor T3 receives a light emitting control signal EM, and a source receives a power source high voltage VDDH, and a drain is electrically coupled to a third node c; a gate of the fourth N type thin film transistor T4 receives the second scan signal Scan2, and a source is electrically coupled to the third node c, and a drain is electrically coupled to a fifth node e; a gate of the fifth P type thin film transistor T5 receives a light emitting control signal EM, and a source is electrically coupled to a fourth node d, and a drain receives a common ground voltage VSS; a gate of the sixth N type thin film transistor T6 receives a first scan signal Scan1, and a source is electrically coupled to the fifth node e, and a drain time-share receives a power source low voltage VDDL or a luminous brightness adjustment voltage Vr; the seventh P type thin film transistor T7 is a driving thin film transistor which directly drives the organic light emitting diode D1, of which a gate is electrically coupled to the first node a, and a source is electrically coupled to the third node c, and a drain is electrically coupled to the second node b; an anode of the organic light emitting diode D1 is electrically coupled to the second node b, and a cathode receives the common ground voltage VSS; one end of the first capacitor C1 is electrically coupled to the first node a, and the other end is electrically coupled to the fourth node d; one end of the second capacitor C2 is electrically coupled to the fourth node d, and the other end is electrically coupled to the fifth node e.

Specifically, all of the first N type thin film transistor T1, the second N type thin film transistor T2, the third N type thin film transistor T3, the fourth N type thin film transistor T4, the fifth P type thin film transistor T5, the sixth N type thin film transistor T6 and the seventh P type thin film transistor T7 are low temperature poly-silicon thin film transistors, oxide semiconductor thin film transistors or amorphous silicon thin film transistors; all of the first scan signal Scan1, the second scan signal Scan2, the third scan signal Scan3, the light emitting control signal EM and the data signal Data are generated by an external sequence controller.

The first scan signal Scan1, the second scan signal Scan2, the third scan signal Scan3, the light emitting control signal EM, and the data signal Data are combined with one another to correspond to a reset stage S1, a threshold voltage detection stage S2, a program stage S3 and a light emitting stage S4 one after another.

Figure 4:
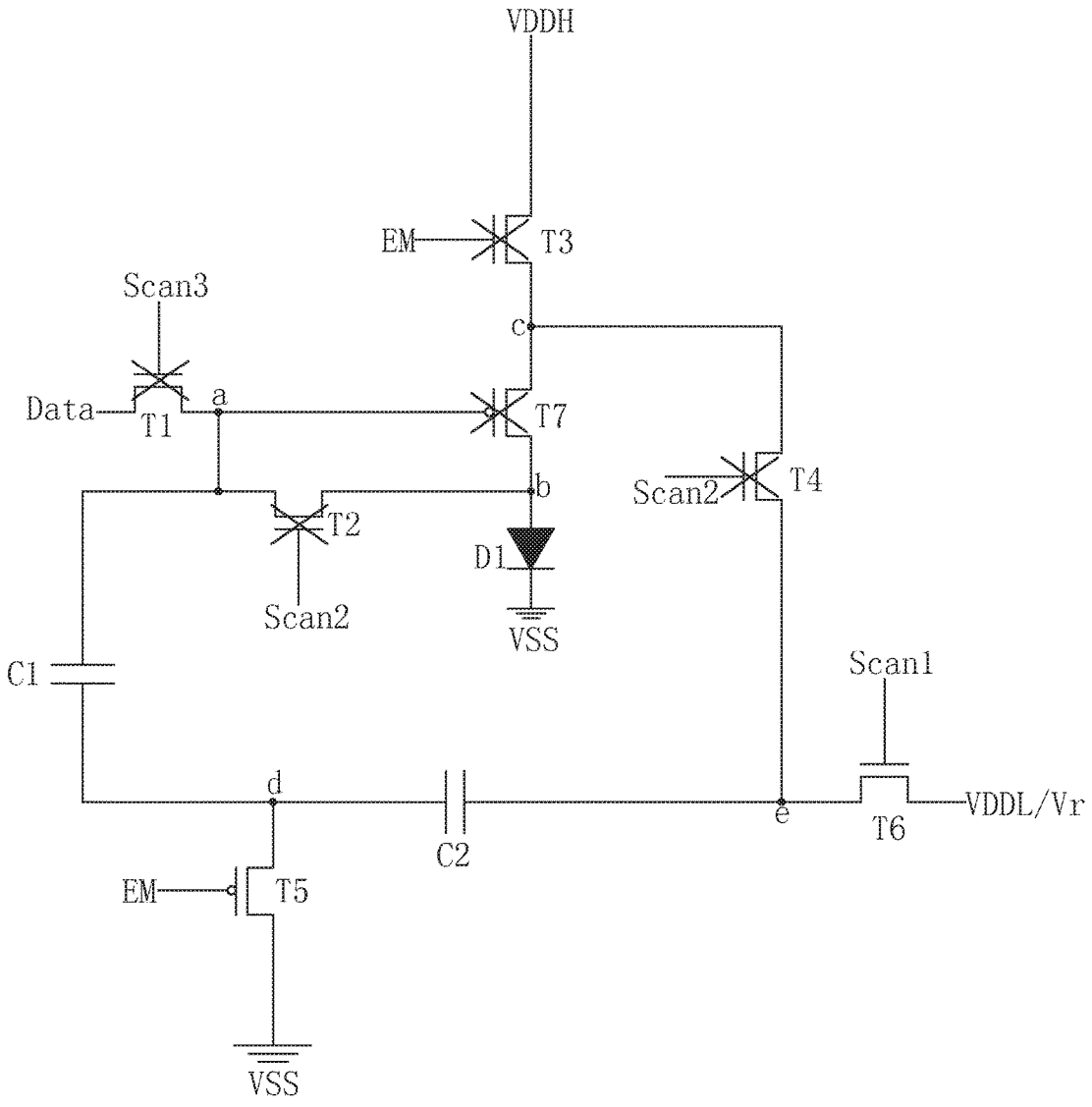
FIG. 4 is a circuit diagram of an OLED pixel driving circuit in a reset stage, and also a circuit diagram of step 2 in the OLED pixel driving method according to the present invention.

Furthermore, combining FIG. 3 and FIG. 4, in the reset stage S1:

the first scan signal Scan1 is a high voltage level, and the second scan signal Scan2 is a low voltage level, and the third scan signal Scan3 is a low voltage level, and the light emitting control signal EM is a low voltage level, and the data signal Data is a low voltage level; the drain of the sixth N type thin film transistor T6 receives the power source low voltage VDDL.

The fifth P type thin film transistor T5 and the sixth N type thin film transistor T6 is on, and the other thin film transistors is off, and the power source low voltage VDDL charges the second capacitor C2 via the sixth N type thin film transistor T6 which is on, and a voltage difference of two ends of the second capacitor C2 after charging is accomplished, i.e. a voltage difference $V_{ed}$ between the fifth node e and the fourth node d is:

$$V_{ed}=VDDL-VSS$$

to accomplish the reset and initializing assignment to the second capacitor C2.

Significantly, the power source low voltage VDDL is higher than a sum of a threshold voltage of the seventh P type thin film transistor T7 and a threshold voltage of the organic light emitting diode D1, i.e.:

$$VDDL>V_{th}+V_{th_OLED}$$

wherein Vth represents a threshold voltage of the seventh P type thin film transistor T7, and $V_{th_OLED}$ is a threshold voltage of the organic light emitting diode D1.

Figure 5:
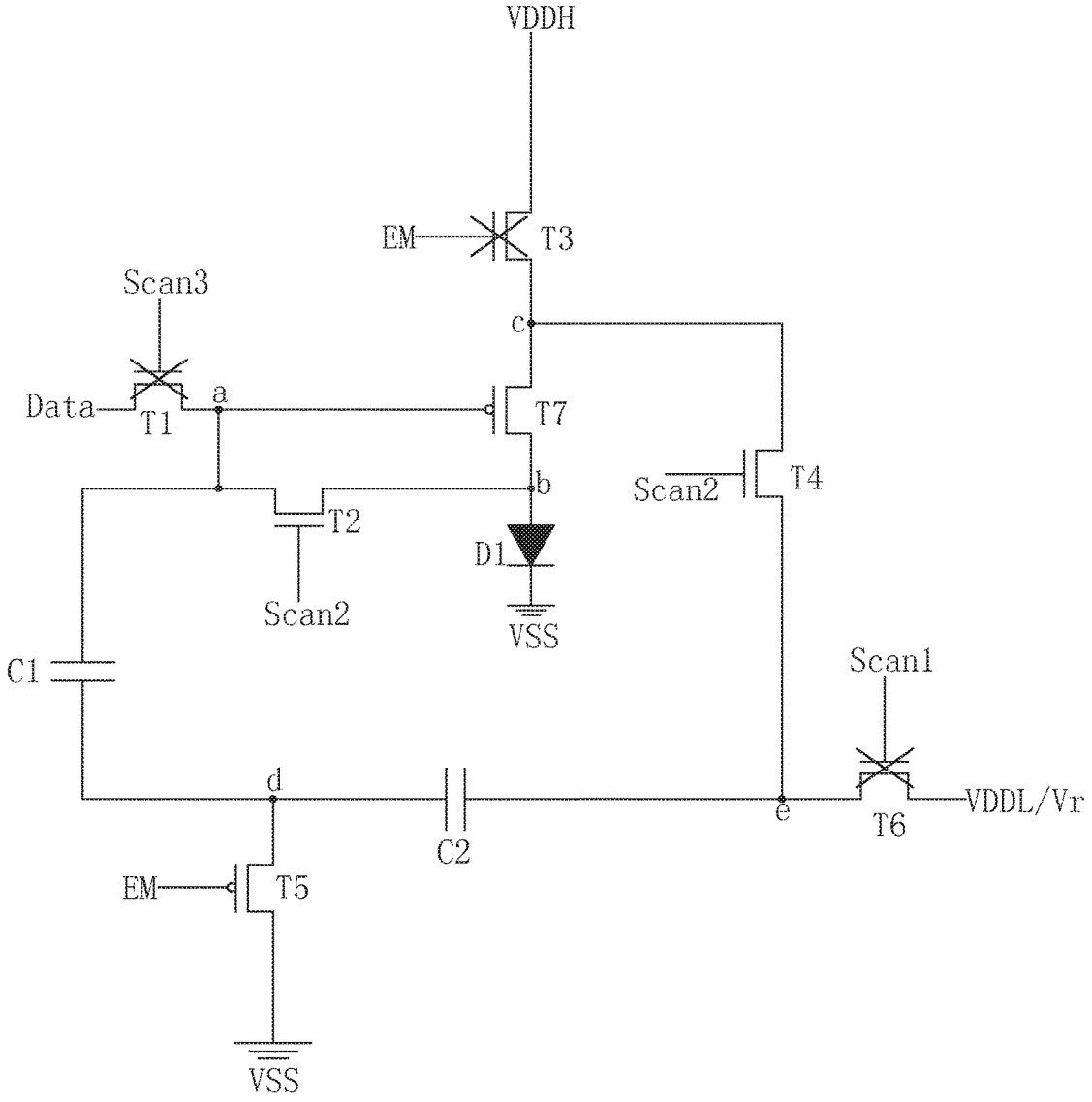
FIG. 5 is a circuit diagram of an OLED pixel driving circuit in a threshold voltage detection stage, and also a circuit diagram of step 3 in the OLED pixel driving method according to the present invention.

Combining FIG. 3 and FIG. 5, in the threshold voltage detection stage S2:

in the threshold voltage detection stage S2, the first scan signal Scan1 is a low voltage level, and the second scan signal Scan2 is a high voltage level, and the third scan signal Scan3 is a low voltage level, and the light emitting control signal EM is a low voltage level, and the data signal Data is a low voltage level.

All of the second N type thin film transistor T2, the fourth N type thin film transistor T4, the fifth P type thin film transistor T5 and the seventh P type thin film transistor T7 are on, and all of the first N type thin film transistor T1, the third N type thin film transistor T3 and the sixth N type thin film transistor T6 are off, and the fifth node e is coupled with the third node c, i.e. the source of the seventh P type thin film transistor T7 via the fourth N type thin film transistor T4 which is on, and the first node a, i.e. the gate of the seventh P type thin film transistor T7 is coupled to the second node b, i.e. the anode of the organic light emitting diode D1 via the second N type thin film transistor T2 which is on, and the second capacitor C2 is discharged to the seventh P type thin film transistor T7 until a voltage difference $V_{ed}$ between the fifth node e and the fourth node d is:

$$V_{ed}=V_{th}+V_{th_OLED}$$

then, an energy storage voltage of the second capacitor C2 is $V_{th}+V_{th_OLED}$.

Figure 6:
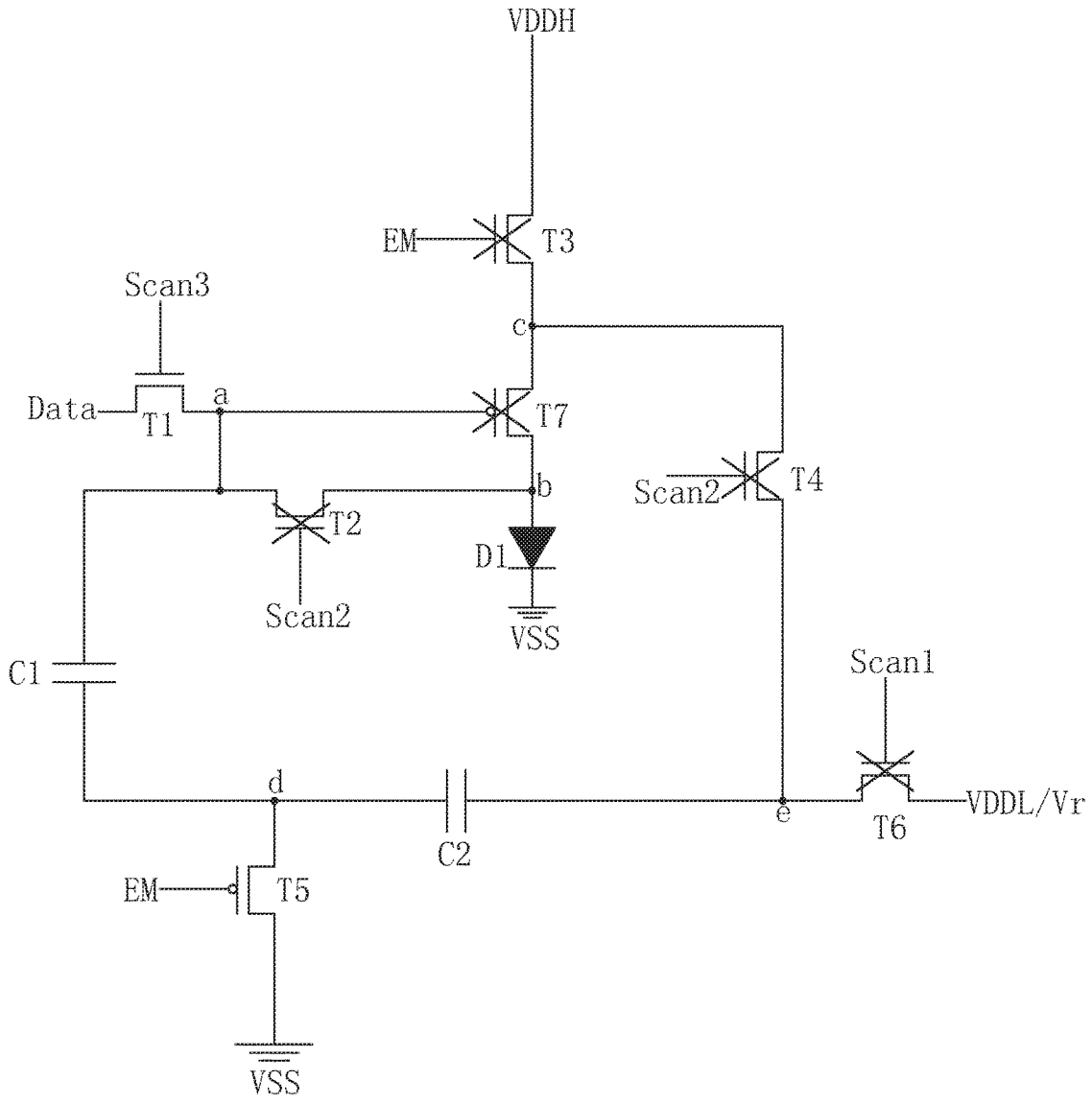
FIG. 6 is a circuit diagram of an OLED pixel driving circuit in a program stage, and also a circuit diagram of step 4 in the OLED pixel driving method according to the present invention.

Combining FIG. 3 and FIG. 6, in the program stage S3:

the first scan signal Scan1 is a low voltage level, and the second scan signal Scan2 is a low voltage level, and the third scan signal Scan3 is a high voltage level, and the light emitting control signal EM is a low voltage level, and the data signal Data is a high voltage level.

The first N type thin film transistor T1 and the fifth P type thin film transistor T5 are on, and the other thin film transistors are off, and the data signal charges the first capacitor C1 via the first N type thin film transistor T1 until an energy storage voltage of the first capacitor C1 and a voltage level of the first node a are a voltage value $V_{Data}$ of a high voltage level provided by the data signal Data.

In the program stage S3, the second capacitor C2 is in a floating state.

Figure 7:
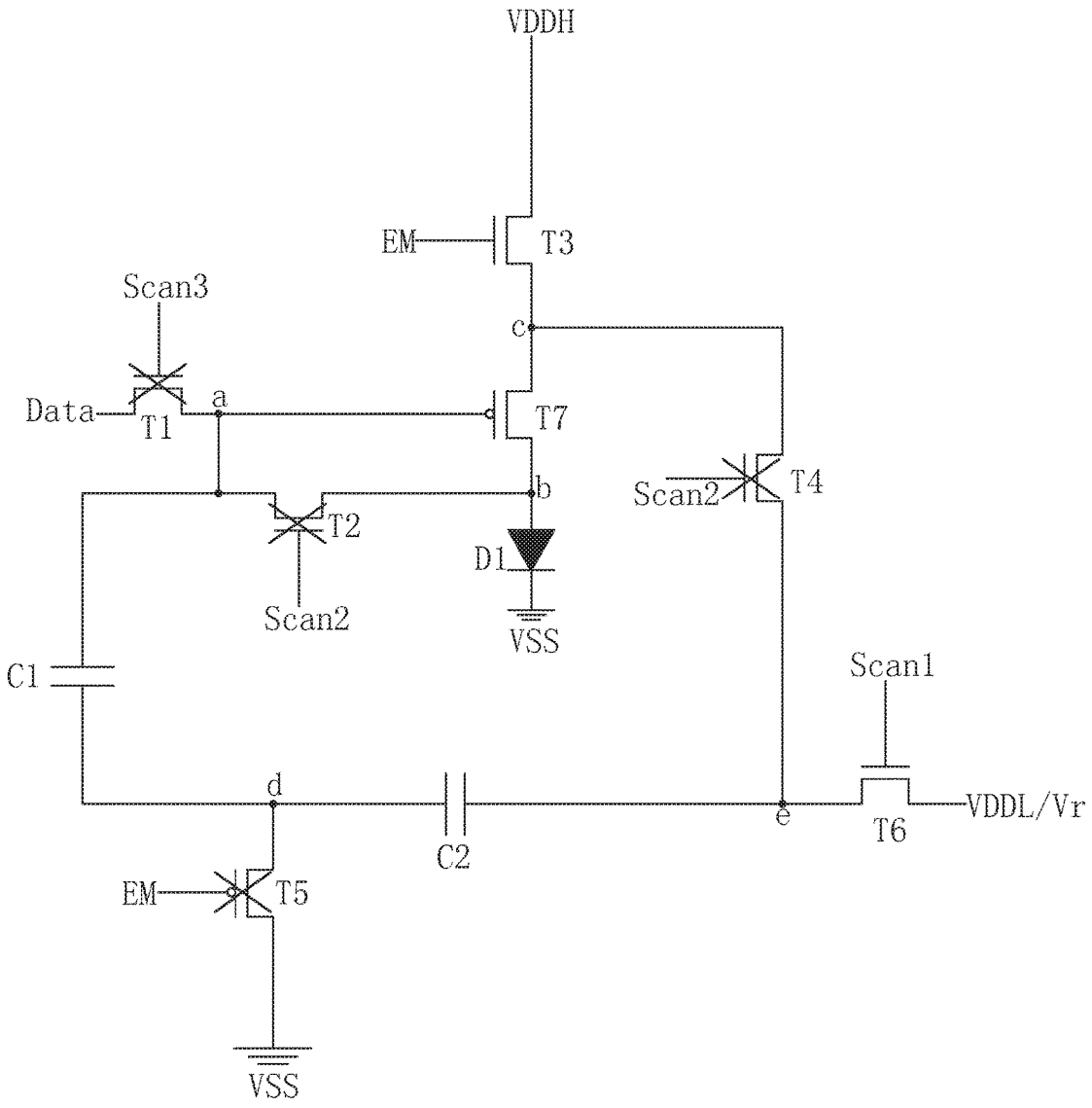
FIG. 7 is a circuit diagram of an OLED pixel driving circuit in a light emitting stage, and also a circuit diagram of step 5 in the OLED pixel driving method according to the present invention.

Combining FIG. 3 and FIG. 7, in the light emitting stage S4:

the first scan signal Scan1 is a high voltage level, and the second scan signal Scan2 is a low voltage level, and the third scan signal Scan3 is a low voltage level, and the light emitting control signal EM is a high voltage level, and the data signal Data is a low voltage level; the drain of the sixth N type thin film transistor T6 receives the luminous brightness adjustment voltage Vr.

All of the third N type thin film transistor T3, the sixth N type thin film transistor T6 and the seventh P type thin film transistor T7 are on, and all of the first N type thin film transistor T1, the second N type thin film transistor T2, the fourth N type thin film transistor T4 and the fifth P type thin film transistor T5 are off, and the luminous brightness adjustment voltage Vr is sent to the fifth node e via the sixth N type thin film transistor T6, and the voltage level Va of the first node a, i.e. a gate voltage level of the seventh P type thin film transistor T7 is changed to be:

$$Va=Vr+(V_{Data}-(V_{th}+V_{th_OLED}))=Vr+V_{Data}-V_{th}-V_{th_OLED}$$

the power source high voltage level VDDH is sent to the third node c, i.e. the source of the seventh P type thin film transistor T7 via the third N type thin film transistor T3 which is on:

$$Vc=VDDH$$

wherein Vc represents a voltage of the third node c, i.e. the source of the seventh P type thin film transistor T7.

The formula of the current flowing through the P type thin film transistor and the organic light emitting diode according to calculation is:

$$\begin{aligned} I_{OLED} &= K\times(Vc-Va-V_{th})^2 \\ &= K\times(VDDH-(Vr+V_{Data}-V_{th}-V_{th_OLED})-V_{th})^2 \\ &= K\times(VDDH-Vr-V_{Data}+V_{th_OLED})^2 \end{aligned}$$

wherein $I_{OLED}$ represents a current flowing through the driving thin film transistor, i.e. the seventh P type thin film transistor T7 and the organic light emitting diode D1, and K is an intrinsic conductive factor of the driving thin film transistor, i.e. the seventh P type thin film transistor T7.

The organic light emitting diode D1 emits light, and the current $I_{OLED}$ flowing through the organic light emitting diode D1 is irrelevant with the threshold voltage Vth of the seventh P type thin film transistor T7, which can eliminate the influence of the threshold voltage of the driving thin film transistor to the current flowing through the organic light emitting diode to promote the OLED panel display uniformity.

Significantly, the common ground voltage VSS is not higher than the luminous brightness adjustment voltage Vr, and the luminous brightness adjustment voltage Vr is lower than a sum of the power source high voltage VDDH and the threshold voltage $V_{th_OLED}$ of the organic light emitting diode D1 minus a voltage value $V_{Data}$ of a high voltage level provided by the data signal Data.

$$VSS\leq Vr<VDDH-V_{Data}+V_{th_OLED}$$

Besides, the above expression formula for calculating $I_{OLED}$, $I_{OLED}=K\times(VDDH-Vr-V_{Data}+V_{th_OLED})^2$ contains the item of threshold voltage $V_{th_OLED}$ of the organic light emitting diode D1. Since the organic light emitting diode D1 will age after a long time usage so that the threshold voltage $V_{th_OLED}$ of the organic light emitting diode D1 rises to result in the decrease of the luminous efficiency. However, it can be told from the expression formula of $I_{OLED}$ that the rising $V_{th_OLED}$ makes the current $I_{OLED}$ flowing through the organic light emitting diode D1 increase, and the increased current can compensate the decreased luminous efficiency for solving the issue of the decreased luminous efficiency.

On the basis of the same inventive idea, the present invention further provides an OLED pixel driving method, comprising steps of:

step 1, providing an OLED pixel driving circuit.

As shown in FIG. 2, the OLED pixel driving circuit utilizes the 7T2C structure and comprises a first N type thin film transistor T1, a second N type thin film transistor T2, a third N type thin film transistor T3, a fourth N type thin film transistor T4, a fifth P type thin film transistor T5, a sixth N type thin film transistor T6, a seventh P type thin film transistor T7, a first capacitor C1, a second capacitor C2 and an organic light emitting diode D1.

A gate of the first N type thin film transistor T1 receives a third scan signal Scan3, and a source receives a data signal Data, and a drain is electrically coupled to a first node a; a gate of the second N type thin film transistor T2 receives a second scan signal Scan2, and a source is electrically coupled to the first node a, and a drain is electrically coupled to a second node b; a gate of the third N type thin film transistor T3 receives a light emitting control signal EM, and a source receives a power source high voltage VDDH, and a drain is electrically coupled to a third node c; a gate of the fourth N type thin film transistor T4 receives the second scan signal Scan2, and a source is electrically coupled to the third node c, and a drain is electrically coupled to a fifth node e; a gate of the fifth P type thin film transistor T5 receives a light emitting control signal EM, and a source is electrically coupled to a fourth node d, and a drain receives a common ground voltage VSS; a gate of the sixth N type thin film transistor T6 receives a first scan signal Scan1, and a source is electrically coupled to the fifth node e, and a drain time-share receives a power source low voltage VDDL or a luminous brightness adjustment voltage Vr; the seventh P type thin film transistor T7 is a driving thin film transistor which directly drives the organic light emitting diode D1, of which a gate is electrically coupled to the first node a, and a source is electrically coupled to the third node c, and a drain is electrically coupled to the second node b; an anode of the organic light emitting diode D1 is electrically coupled to the second node b, and a cathode receives the common ground voltage VSS; one end of the first capacitor C1 is electrically coupled to the first node a, and the other end is electrically coupled to the fourth node d; one end of the second capacitor C2 is electrically coupled to the fourth node d, and the other end is electrically coupled to the fifth node e.

Specifically, all of the first N type thin film transistor T1, the second N type thin film transistor T2, the third N type thin film transistor T3, the fourth N type thin film transistor T4, the fifth P type thin film transistor T5, the sixth N type thin film transistor T6 and the seventh P type thin film transistor T7 are low temperature poly-silicon thin film transistors, oxide semiconductor thin film transistors or amorphous silicon thin film transistors; all of the first scan signal Scan1, the second scan signal Scan2, the third scan signal Scan3, the light emitting control signal EM and the data signal Data are generated by an external sequence controller.

step 2, referring to FIG. 3 and FIG. 4, together, entering the reset stage S1.

The first scan signal Scan1 provides a high voltage level, and the second scan signal Scan2 provides a low voltage level, and the third scan signal Scan3 provides a low voltage level, and the light emitting control signal EM provides a low voltage level, and the data signal Data provides a low voltage level; the drain of the sixth N type thin film transistor T6 receives the power source low voltage VDDL.

The fifth P type thin film transistor T5 and the sixth N type thin film transistor T6 is on, and the other thin film transistors is off, and the power source low voltage VDDL charges the second capacitor C2 via the sixth N type thin film transistor T6 which is on, and a voltage difference of two ends of the second capacitor C2 after charging is accomplished, i.e. a voltage difference $V_{ed}$ between the fifth node e and the fourth node d is:

$$V_{ed}=VDDL-VSS$$

to accomplish the reset and initializing assignment to the second capacitor C2.

Significantly, the power source low voltage VDDL is higher than a sum of a threshold voltage of the seventh P type thin film transistor T7 and a threshold voltage of the organic light emitting diode D1, i.e.:

$$VDDL>V_{th}+V_{th_OLED}$$

wherein $V_{th}$ represents a threshold voltage of the seventh P type thin film transistor T7, and $V_{th_OLED}$ is a threshold voltage of the organic light emitting diode D1.

step 3, Combining FIG. 3 and FIG. 5, entering the threshold voltage detection stage S2.

The first scan signal Scan1 is changed to be a low voltage level, and the second scan signal Scan2 is changed to be a high voltage level, and the third scan signal Scan3 is kept to be a low voltage level, and the light emitting control signal EM is kept to be a low voltage level, and the data signal Data is kept to be a low voltage level.

All of the second N type thin film transistor T2, the fourth N type thin film transistor T4, the fifth P type thin film transistor T5 and the seventh P type thin film transistor T7 are on, and all of the first N type thin film transistor T1, the third N type thin film transistor T3 and the sixth N type thin film transistor T6 are off, and the fifth node e is coupled with the third node c, i.e. the source of the seventh P type thin film transistor T7 via the fourth N type thin film transistor T4 which is on, and the first node a, i.e. the gate of the seventh P type thin film transistor T7 is coupled to the second node b, i.e. the anode of the organic light emitting diode D1 via the second N type thin film transistor T2 which is on, and the second capacitor C2 is discharged to the seventh P type thin film transistor T7 until a voltage difference $V_{ed}$ between the fifth node e and the fourth node d is:

$$V_{ed}=V_{th}+V_{th_OLED}$$

then, an energy storage voltage of the second capacitor C2 is $V_{th}+V_{th_OLED}$.

step 4, combining FIG. 3 and FIG. 6, entering the program stage S3.

The first scan signal Scan1 is kept to be a low voltage level, and the second scan signal Scan2 is changed to be a low voltage level, and the third scan signal Scan3 is changed to be a high voltage level, and the light emitting diode control signal EM is kept to be a low voltage level, and the data signal Data is changed to be a high voltage level.

The first N type thin film transistor T1 and the fifth P type thin film transistor T5 are on, and the other thin film transistors are off, and the data signal charges the first capacitor C1 via the first N type thin film transistor T1 until an energy storage voltage of the first capacitor C1 and a voltage level of the first node a are a voltage value $V_{Data}$ of a high voltage level provided by the data signal Data.

In the program stage S3, the second capacitor C2 is in a floating state.

step 5, combining FIG. 3 and FIG. 7, entering the light emitting stage S4.

the first scan signal Scan1 is changed to be a high voltage level, and the second scan signal Scan2 is kept to be a low voltage level, and the third scan signal Scan3 is changed to be a low voltage level, and the light emitting control signal EM is changed to be a high voltage level, and the data signal Data is changed to be a low voltage level; the drain of the sixth N type thin film transistor T6 receives the luminous brightness adjustment voltage Vr.

All of the third N type thin film transistor T3, the sixth N type thin film transistor T6 and the seventh P type thin film transistor T7 are on, and all of the first N type thin film transistor T1, the second N type thin film transistor T2, the fourth N type thin film transistor T4 and the fifth P type thin film transistor T5 are off, and the luminous brightness adjustment voltage Vr is sent to the fifth node e via the sixth N type thin film transistor T6, and the voltage level Va of the first node a, i.e. a gate voltage level of the seventh P type thin film transistor T7 is changed to be:

$$Va=Vr+(V_{Data}-(V_{th}+V_{th_OLED}))=Vr+V_{Data}-V_{th}-V_{th_OLED}$$

the power source high voltage level VDDH is sent to the third node c, i.e. the source of the seventh P type thin film transistor T7 via the third N type thin film transistor T3 which is on:

$$Vc=VDDH$$

wherein Vc represents a voltage of the third node c, i.e. the source of the seventh P type thin film transistor T7.

The formula of the current flowing through the P type thin film transistor and the organic light emitting diode according to calculation is:

$$\begin{aligned} I_{OLED} &= K\times(Vc-Va-V_{th})^2 \\ &= K\times(VDDH-(Vr+V_{Data}-V_{th}-V_{th_OLED})-V_{th})^2 \\ &= K\times(VDDH-Vr-V_{Data}+V_{th_OLED})^2 \end{aligned}$$

wherein $I_{OLED}$ represents a current flowing through the driving thin film transistor, i.e. the seventh P type thin film transistor T7 and the organic light emitting diode D1, and K is an intrinsic conductive factor of the driving thin film transistor, i.e. the seventh P type thin film transistor T7.

The organic light emitting diode D1 emits light, and the current $I_{OLED}$ flowing through the organic light emitting diode D1 is irrelevant with the threshold voltage $V_{th}$ of the seventh P type thin film transistor T7, which can eliminate the influence of the threshold voltage of the driving thin film transistor to the current flowing through the organic light emitting diode to promote the OLED panel display uniformity.

Significantly, the common ground voltage VSS is not higher than the luminous brightness adjustment voltage Vr, and the luminous brightness adjustment voltage Vr is lower than a sum of the power source high voltage VDDH and the threshold voltage $V_{th_OLED}$ of the organic light emitting diode D1 minus a voltage value $V_{Data}$ of a high voltage level provided by the data signal Data.

$$VSS\leq Vr<VDDH-V_{Data}+V_{th_OLED}$$

Besides, the above expression formula for calculating $I_{OLED}$, $I_{OLED}=K\times(VDDH-Vr-V_{Data}+V_{th_OLED})^2$ contains the item of threshold voltage $V_{th_OLED}$ of the organic light emitting diode D1. Since the organic light emitting diode D1 will age after a long time usage so that the threshold voltage $V_{th_OLED}$ of the organic light emitting diode D1 rises to result in the decrease of the luminous efficiency. However, it can be told from the expression formula of $I_{OLED}$ that the rising $V_{th_OLED}$ makes the current $I_{OLED}$ flowing through the organic light emitting diode D1 increase, and the increased current can compensate the decreased luminous efficiency for solving the issue of the decreased luminous efficiency.

In conclusion, the OLED pixel driving circuit and the pixel driving method of the present invention utilizes the pixel driving circuit of 7T2C structure, and the first scan signal, the second scan signal, the third scan signal, the light emitting control signal and the data signal are combined with one another to correspond to a reset stage, a threshold voltage detection stage, a program stage and a light emitting stage one after another and can eliminate the influence of the threshold voltage of the driving thin film transistor to the current flowing through the organic light emitting diode to promote the OLED panel display uniformity.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An OLED pixel driving circuit, comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node.

2. The OLED pixel driving circuit according to claim 1, wherein the first scan signal, the second scan signal, the third scan signal, the light emitting control signal, and the data signal are combined with one another to correspond to a reset stage, a threshold voltage detection stage, a program stage and a light emitting stage one after another, in the reset stage, the first scan signal is a high voltage level, and the second scan signal is a low voltage level, and the third scan signal is a low voltage level, and the light emitting control signal is a low voltage level, and the data signal is a low voltage level; the drain of the sixth N type thin film transistor receives the power source low voltage; in the threshold voltage detection stage, the first scan signal is a high voltage level, and the second scan signal is a low voltage level, and the light emitting control signal is a low voltage level, and the data signal is a low voltage level; in the program stage, the first scan signal is a low voltage level, and the second scan signal is a low voltage level, and the third scan signal is a high voltage level, and the light emitting control signal is a low voltage level, and the data signal is a high voltage level; in the light emitting stage, the first scan signal is a high voltage level, and the second scan signal is a low voltage level, and the third scan signal is a low voltage level, and the light emitting control signal is a high voltage level, and the data signal is a low voltage level; the drain of the sixth N type thin film transistor receives the luminous brightness adjustment voltage.

3. The OLED pixel driving circuit according to claim 1, wherein the power source low voltage is higher than a sum of a threshold voltage of the seventh P type thin film transistor and a threshold voltage of the organic light emitting diode.

4. The OLED pixel driving circuit according to claim 3, wherein the common ground voltage is not higher than the luminous brightness adjustment voltage, and the luminous brightness adjustment voltage is lower than a sum of the power source high voltage and the threshold voltage of the organic light emitting diode minus a voltage value of a high voltage level provided by the data signal.

5. The OLED pixel driving circuit according to claim 1, wherein all of the first scan signal, the second scan signal, the third scan signal, the light emitting control signal and the data signal are generated by an external sequence controller.

6. The OLED pixel driving circuit according to claim 1, wherein all of the first N type thin film transistor, the second N type thin film transistor, the third N type thin film transistor, the fourth N type thin film transistor, the fifth P type thin film transistor, the sixth N type thin film transistor, the seventh P type thin film transistor are low temperature poly-silicon thin film transistors, oxide semiconductor thin film transistors or amorphous silicon thin film transistors.

7. An OLED pixel driving method, comprising steps of:

step 1, providing an OLED pixel driving circuit;

the OLED pixel driving circuit comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node;

step 2, entering a reset stage;

the first scan signal providing a high voltage level, and the second scan signal providing a low voltage level, and the third scan signal providing a low voltage level, and the light emitting control signal providing a low voltage level, and the data signal providing a low voltage level; the drain of the sixth N type thin film transistor receiving the power source low voltage;

the fifth P type thin film transistor and the sixth N type thin film transistor being on, and the other thin film transistors being off, and the power source low voltage charging the second capacitor to perform initializing assignment to the second capacitor, and resetting a voltage difference of two ends of the second capacitor to be VDDL-VSS, wherein VDDL represents the power source low voltage, and VSS represents the common ground voltage;

step 3, entering a threshold voltage detection stage;

the first scan signal being changed to be a low voltage level, and the second scan signal being changed to be a high voltage level, and the third scan signal being kept to be a low voltage level, and the light emitting control signal being kept to be a low voltage level, and the data signal being kept to be a low voltage level;

all of the second N type thin film transistor, the fourth N type thin film transistor, the fifth P type thin film transistor and the seventh P type thin film transistor being on, and all of the first N type thin film transistor, the third N type thin film transistor and the sixth N type thin film transistor being off, and the second capacitor being discharged to the seventh P type thin film transistor until an energy storage voltage of the second capacitor is $V_{th}+V_{th_OLED}$, wherein $V_{th}$ is a threshold voltage of the seventh P type thin film transistor, and $V_{th_OLED}$ is a threshold voltage of the organic light emitting diode;

step 4, entering a program stage;

the first scan signal being kept to be a low voltage level, and the second scan signal being changed to be a low voltage level, and the third scan signal being changed to be a high voltage level, and the light emitting diode control signal being kept to be a low voltage level, and the data signal being changed to be a high voltage level;

the first N type thin film transistor and the fifth P type thin film transistor being on, and the other thin film transistors being off, and the data signal charging the first capacitor until an energy storage voltage of the first capacitor and a voltage level of the first node are $V_{Data}$, and $V_{Data}$ is a voltage value of a high voltage level provided by the data signal;

step 5, entering a light emitting stage;

the first scan signal being changed to be a high voltage level, and the second scan signal being kept to be a low voltage level, and the third scan signal being changed to be a low voltage level, and the light emitting control signal being changed to be a high voltage level, and the data signal being changed to be a low voltage level; the drain of the sixth N type thin film transistor receiving the luminous brightness adjustment voltage;

all of the third N type thin film transistor, the sixth N type thin film transistor and the fifth P type thin film transistor being on, and all of the first N type thin film transistor, the second N type thin film transistor, the fourth N type thin film transistor and the fifth P type thin film transistor being off, and the luminous brightness adjustment voltage being sent to the fifth node, and the voltage level of the first node being changed to be:

$$Va=Vr+V_{Data}-V_{th}-V_{th_OLED}$$

wherein Va represents a voltage level of the first node, and Vr represents the luminous brightness adjustment voltage;

the organic light emitting diode emits light, and a current flowing through the organic light emitting diode is irrelevant with the threshold voltage of the seventh P type thin film transistor.

8. The OLED pixel driving method according to claim 7, wherein the power source low voltage is higher than a sum of a threshold voltage of the seventh P type thin film transistor and a threshold voltage of the organic light emitting diode.

9. The OLED pixel driving method according to claim 8, wherein the common ground voltage is not higher than the luminous brightness adjustment voltage, and the luminous brightness adjustment voltage is lower than a sum of the power source high voltage and the threshold voltage of the organic light emitting diode minus a voltage value of a high voltage level provided by the data signal.

10. The OLED pixel driving method according to claim 7, wherein all of the first scan signal, the second scan signal, the third scan signal, the light emitting control signal and the data signal are generated by an external sequence controller, and all of the first N type thin film transistor, the second N type thin film transistor, the third N type thin film transistor, the fourth N type thin film transistor, the fifth P type thin film transistor, the sixth N type thin film transistor, the seventh P type thin film transistor are low temperature poly-silicon thin film transistors, oxide semiconductor thin film transistors or amorphous silicon thin film transistors.

11. An OLED pixel driving circuit, comprising a first N type thin film transistor, a second N type thin film transistor, a third N type thin film transistor, a fourth N type thin film transistor, a fifth P type thin film transistor, a sixth N type thin film transistor, a seventh P type thin film transistor, a first capacitor, a second capacitor and an organic light emitting diode; the seventh P type thin film transistor serving as a driving thin film transistor of the organic light emitting diode;

a gate of the first N type thin film transistor receiving a third scan signal, and a source receiving a data signal, and a drain being electrically coupled to a first node;

a gate of the second N type thin film transistor receiving a second scan signal, and a source being electrically coupled to the first node, and a drain being electrically coupled to a second node;

a gate of the third N type thin film transistor receiving a light emitting control signal, and a source receiving a power source high voltage, and a drain being electrically coupled to a third node;

a gate of the fourth N type thin film transistor receiving the second scan signal, and a source being electrically coupled to the third node, and a drain being electrically coupled to a fifth node;

a gate of the fifth P type thin film transistor receiving a light emitting control signal, and a source being electrically coupled to a fourth node, and a drain receiving a common ground voltage;

a gate of the sixth N type thin film transistor receiving a first scan signal, and a source being electrically coupled to the fifth node, and a drain time-share receiving a power source low voltage or a luminous brightness adjustment voltage;

a gate of the seventh P type thin film transistor being electrically coupled to the first node, and a source being electrically coupled to the third node, and a drain being electrically coupled to the second node;

an anode of the organic light emitting diode being electrically coupled to the second node, and a cathode receiving the common ground voltage;

one end of the first capacitor being electrically coupled to the first node, and the other end being electrically coupled to the fourth node;

one end of the second capacitor being electrically coupled to the fourth node, and the other end being electrically coupled to the fifth node;

wherein the first scan signal, the second scan signal, the third scan signal, the light emitting control signal, and the data signal are combined with one another to correspond to a reset stage, a threshold voltage detection stage, a program stage and a light emitting stage one after another;

in the reset stage, the first scan signal is a high voltage level, and the second scan signal is a low voltage level, and the third scan signal is a low voltage level, and the light emitting control signal is a low voltage level, and the data signal is a low voltage level; the drain of the sixth N type thin film transistor receives the power source low voltage;

in the threshold voltage detection stage, the first scan signal is a high voltage level, and the second scan signal is a low voltage level, and the light emitting control signal is a low voltage level, and the data signal is a low voltage level;

in the program stage, the first scan signal is a low voltage level, and the second scan signal is a low voltage level, and the third scan signal is a high voltage level, and the light emitting control signal is a low voltage level, and the data signal is a high voltage level;

in the light emitting stage, the first scan signal is a high voltage level, and the second scan signal is a low voltage level, and the third scan signal is a low voltage level, and the light emitting control signal is a high voltage level, and the data signal is a low voltage level; the drain of the sixth N type thin film transistor receives the luminous brightness adjustment voltage;

wherein all of the first scan signal, the second scan signal, the third scan signal, the light emitting control signal and the data signal are generated by an external sequence controller.

12. The OLED pixel driving circuit according to claim 11, wherein the power source low voltage is higher than a sum of a threshold voltage of the seventh P type thin film transistor and a threshold voltage of the organic light emitting diode.

13. The OLED pixel driving circuit according to claim 12, wherein the common ground voltage is not higher than the luminous brightness adjustment voltage, and the luminous brightness adjustment voltage is lower than a sum of the power source high voltage and the threshold voltage of the organic light emitting diode minus a voltage value of a high voltage level provided by the data signal.

14. The OLED pixel driving circuit according to claim 11, wherein all of the first N type thin film transistor, the second N type thin film transistor, the third N type thin film transistor, the fourth N type thin film transistor, the fifth P type thin film transistor, the sixth N type thin film transistor, the seventh P type thin film transistor are low temperature poly-silicon thin film transistors, oxide semiconductor thin film transistors or amorphous silicon thin film transistors.

* * * * *